US007854284B2

(12) United States Patent
Wada et al.

(10) Patent No.: US 7,854,284 B2
(45) Date of Patent: Dec. 21, 2010

(54) UPPER ROTATING BODY AND CONSTRUCTION MACHINE THEREWITH

(75) Inventors: Noriyuki Wada, Hiroshima (JP); Kazuyuki Takeda, Hiroshima (JP); Yuka Nakagawa, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 194 days.

(21) Appl. No.: 12/110,778

(22) Filed: Apr. 28, 2008

(65) Prior Publication Data

US 2008/0282586 A1 Nov. 20, 2008

(30) Foreign Application Priority Data

May 15, 2007 (JP) ..... 2007-129667

(51) Int. Cl.
*B62D 33/063* (2006.01)

(52) U.S. Cl. ..... 180/89.13; 180/327; 180/6.58

(58) Field of Classification Search ..... 180/89.13, 180/327, 6.58; 37/466; 296/190.04
See application file for complete search history.

(56) References Cited

U.S. PATENT DOCUMENTS 6,009,643 A * 1/2000 Maeba et al. ..... 37/443
6,134,816 A 10/2000 Murakami et al.
2002/0124892 A1* 9/2002 Yamaguchi ..... 137/596.15
2005/0166429 A1* 8/2005 Tanaka et al. ..... 37/466

FOREIGN PATENT DOCUMENTS

| | | |
|---|---|---|
| EP | 0 807 720 A1 | 11/1997 |
| EP | 1 176 259 A1 | 1/2002 |
| JP | 11-181829 | 7/1999 |
| JP | 11-200408 | 7/1999 |
| JP | 2003-56006 | 2/2003 |
| JP | 2004-116197 | 4/2004 |

* cited by examiner

*Primary Examiner*—Paul N Dickson
*Assistant Examiner*—Keith Frisby
(74) *Attorney, Agent, or Firm*—Oblon, Spivak, McClelland, Maier & Neustadt, L.L.P.

(57) ABSTRACT

The present invention is provided with a pair of vertical plates disposed on a rotating frame, a fuel tank and a working oil tank aligned on the rotating frame in the front-back direction, hydraulic pipes for coupling a control valve provided in the working oil tank and a working actuator, and a retaining tool for retaining the hydraulic pipes between the control valve and the actuator, and the hydraulic pipes are arranged from the control valve to the retaining tool through a clearance formed between the fuel tank and the working oil tank.

7 Claims, 6 Drawing Sheets

UPPER ROTATING BODY AND CONSTRUCTION MACHINE THEREWITH

BACKGROUND OF THE INVENTION

1. Field of the Invention

The present invention relates to a structure of an upper rotating body of a construction machine such as a hydraulic excavator.

2. Description of the Related Art

There is a known construction machine provided with an upper rotating body rotatably mounted on a lower travelling body.

The upper rotating body is provided with a working attachment which is supported by a pair of left and right vertical plates disposed on a rotating frame so as to be raised and lowered, actuators such as a boom cylinder and an arm cylinder disposed in the attachment, a working oil tank and a control valve disposed lateral to the vertical plates, and hydraulic pipes for coupling the control valve and the actuators.

In the above type of upper rotating body, there is sometimes a case where a retaining tool for bundling and retaining the pipes so as to prevent the hydraulic pipes from going apart from each other in accordance with an action of the attachment is attached to the vertical plates.

For example, Japanese Patent Laid-Open No. Hei11-181829 discloses a technique that efficiency for arrangement space of hydraulic pipes is improved by inserting a plurality of hydraulic pipes for coupling cylinders (actuators) for activating a working machine (working attachment) and a control valve into a space portion provided below a working oil tank.

However, as in the above Patent Document, in the case where the hydraulic pipes are arranged between the control valve and the retaining tool through the space portion below the working oil tank, there is a need for arranging the hydraulic pipes by once taking the hydraulic pipes through below the working oil tank and then bringing the hydraulic pipes up again to the retaining tool. Therefore, there is a problem that an arrangement route is lengthened by taking the hydraulic pipes through below the working oil tank once.

When the arrangement route is lengthened as mentioned above, pressure loss of working oil flowing through the hydraulic pipes is increased so that drive efficiency for the actuators by the working oil is decreased.

SUMMARY OF THE INVENTION

It is an object of the present invention to provide an upper rotating body capable of shortening an arrangement route of hydraulic pipes and a construction machine therewith.

The present invention is an upper rotating body of a construction machine, comprising a rotating frame rotatably mounted on a lower traveling body, a pair of left and right vertical plates disposed on the rotating frame, a working attachment supported by the vertical plates so as to be raised and lowered from the rotating frame, an actuator provided in the working attachment, a fuel tank provided at a position on the opposite side of one of the vertical plates from the other, a working oil tank provided on the rotating frame and aligned with the fuel tank in the front-back direction, a control valve provided on the opposite side of the working oil tank from the one of vertical plates, hydraulic pipes for coupling the control valve and the actuator, and a retaining tool for retaining at least one of the hydraulic pipes between the control valve and the actuator, the retaining tool being provided in the one of vertical plates, wherein a first clearance is formed between the fuel tank and the working oil tank, and at least one of the hydraulic pipes retained by the retaining tool is arranged between the control valve and the retaining tool through the first clearance.

According to the present invention, the hydraulic pipes retained by the retaining tool can be arranged through the first clearance formed between the fuel tank and the working oil tank. Therefore, in comparison with the conventional case where the hydraulic pipes are arranged by taking the hydraulic pipes through below the working oil tank, it is possible to shorten an arrangement route of the hydraulic pipes in the up and down direction. Consequently, according to the present invention, it is possible to reduce pressure loss generated within the hydraulic pipes.

It should be noted that "at least one of the hydraulic pipes" of the present invention indicates that when at least one of the hydraulic pipes is arranged through the first clearance, all the other hydraulic pipes except the one may be arranged by taking the other hydraulic pipes through below the working oil tank.

In the upper rotating body mentioned above, it is preferable that a second clearance is formed between the working oil tank and the rotating frame, and hydraulic pipes arranged between the vertical plates among the hydraulic pipes are led to between the vertical plates through the second clearance, while remaining hydraulic pipes other than the hydraulic pipes arranged between the vertical plates are led to the retaining tool through the first clearance.

In the above case, it is possible to lead the hydraulic pipes to between the vertical plates by passing below the working oil tank. Therefore, there is no need for avoiding the working oil tank in the planar direction in order to lead the hydraulic pipes to between the vertical plates. Consequently, it is possible to improve efficiency for arrangement space.

It is preferable that the upper rotating body mentioned above further comprises a swivel joint adapted to supply working oil to the lower traveling body, the swivel joint being provided on the rotating frame, and relay pipes for coupling the swivel joint and the control valve, the relay pipes being arranged through the second clearance.

In the above case, it is possible to lead the relay pipes arranged between the control valve to the swivel joint through the second clearance without avoiding the working oil tank in the planar direction (avoiding in the up and down direction). Therefore, it is possible to arrange the relay pipes without changing surface size of the rotating frame.

In the upper rotating body mentioned above, it is favorable that the control valve is provided with a first connecting portion for connecting the hydraulic pipes passing through the first clearance, and a second connecting portion for connecting the hydraulic pipes passing through the second clearance and the relay pipes, and the first connecting portion is formed on the upper side of the second connecting portion.

In the above case, the first connecting portion for connecting the hydraulic pipes to be scheduled to go towards the upper side through the first clearance is arranged on the upper side and the second connecting portion for connecting the hydraulic pipes arranged on the lower side through the second clearance and the relay pipes is arranged on the lower side. Therefore, it is possible to suppress crossing of the pipes connected to both the connecting portions. As a result, it is possible to align the pipes in a regular manner and also to further shorten the arrangement route.

In the upper rotating body mentioned above, it is preferable that a pin inserting and removing portion into and from which a boom foot pin for axially supporting the attachment is insertable and removable in the lateral direction is formed in each of the vertical plates, and the pin inserting and removing portion and the first clearance are provided at corresponding positions in the front-back direction.

In the above case, it is possible to insert and remove the boom foot pin through the first clearance. Therefore, in comparison with the case where there is a need for removing the working oil tank and the fuel tank in order to insert and remove the boom foot pin, it is possible to improve workability.

It is preferable that the upper rotating body mentioned above further comprises an operation pipe adapted to supply pilot pressure to the control valve, the operation pipe being connected to the control valve, wherein all the hydraulic pipes passing through the first clearance are arranged in a range on the upper side of the pin inserting and removing portion, while the operation pipe is arranged in a range below the pin inserting and removing portion through the first clearance.

In the above case, the hydraulic pipes passing through the first clearance and the operation pipe are arranged and divided into the upper and lower sides taking a position of the pin inserting and removing portion as a border. Therefore, it is possible to divide arrangement positions of two types of pipes having different roles from each other into the upper and lower sides. Consequently, it is possible to improve efficiency for arrangement work by suppressing crossing of the hydraulic pipes and the operation pipe.

In the upper rotating body mentioned above, it is preferable that the operation pipe is arranged between an operator's seat provided on the opposite side of the vertical plates from the control valve and the control valve through insertion holes formed on the vertical plates.

In the above case, it is possible to lead the operation pipe arranged through the first clearance to the operator's seat through the insertion holes formed on the vertical plates. Therefore, in comparison with the case of avoiding the vertical plates in the up and down direction or in the planar direction, it is possible to shorten an arrangement route of the operation pipe so as to ease pressure loss within the operation pipe.

It is preferable that the upper rotating body mentioned above further comprises retaining means for retaining the hydraulic pipes passing through the first clearance, the retaining means capable of retaining the hydraulic pipes so that the hydraulic pipes are not overlapped with the pin inserting and removing portion when the pin inserting and removing portion is seen from the side through the first clearance.

In the above case, the hydraulic pipes are retained by the retaining means so that the pin inserting and removing portion is not hidden by the hydraulic pipes passing through the first clearance. Therefore, it is possible to perform insertion and removal work of the boom foot pin without disturbance of the hydraulic pipes.

In the upper rotating body mentioned above, it is favorable that the retaining means is fixed to the working oil tank.

In the above case, by attaching the working oil tank to the rotating frame prior to the fuel tank, it is possible to arrange the hydraulic pipes with utilizing the retaining means. Therefore, in comparison with the case where the hydraulic pipes are arranged after the fuel tank is attached to the rotating frame, the arrangement work is easily performed by using wide surrounding space.

In the upper rotating body mentioned above, it is preferable that the retaining means has a hook portion adapted to accept the hydraulic pipes from the upper side and regulate frontward, rearward and downward movement of the hydraulic pipes, and a protection member installed to the hydraulic pipes so as to cover a part retained by the hook portion is further provided.

In the above case, it is possible to protect the part of the hydraulic pipes brought in contact with the hook portion. Therefore, it is possible to suppress abrasion of the hydraulic pipes due to sliding with the hook portion. Particularly, in the case where the hydraulic pipes are arranged along a curved route, a curved part tends to return straight as working oil pressure within the hydraulic pipes is increased. However, in such a case, by providing the protection member between the hook portion and the hydraulic pipes, protection of the hydraulic pipes is sufficiently performed.

The present invention is to provide a construction machine, comprising a lower traveling body, and the upper rotating body mentioned above and rotatably provided on the lower traveling body.

DESCRIPTION OF THE PREFERRED EMBODIMENTS

Hereinafter, a description will be given to a preferred embodiment of the present invention with reference to the drawings.

Figure 1:
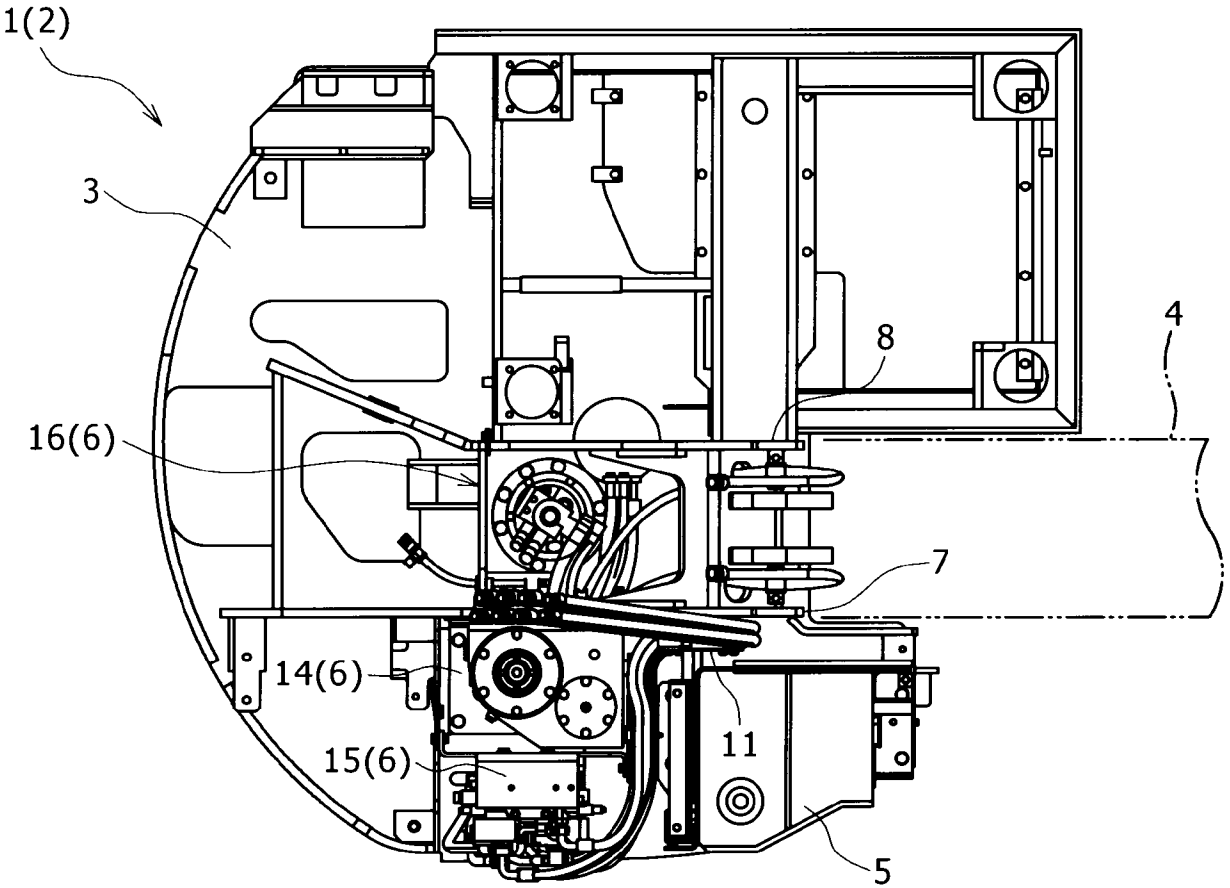
FIG. 1 is a partially schematic plan view showing an upper rotating body of a hydraulic excavator according to an embodiment of the present invention.

FIG. 1 is a partially schematic plan view showing an upper rotating body of a hydraulic excavator according to an embodiment of the present plate 7 through the through hole and the second clearance S2.

Referring to FIGS. 1 to 4, a hydraulic excavator 1 is provided with a lower traveling body (not shown) and an upper rotating body 2 rotatably mounted on the lower traveling body.

The upper rotating body 2 is provided with a rotating frame 3 attached on the lower traveling body, a working attachment 4 supported at a front part of the rotating frame 3, an actuator (not shown) for activating the working attachment 4, a fuel tank 5 and a hydraulic system 6 disposed on the rotating frame 3.

In the rotating frame 3, a pair of left and right vertical plates 7 and 8 disposed along the front-back direction are provided. In a front part of each of the vertical plates 7 and 8, a boss (pin inserting and removing portion) 10 into and from which a boom foot pin 9 is insertable and removable is provided. By inserting the boom foot pin 9 into the boss 10, the working attachment (boom) 4 arranged between the vertical plates 7 and 8 is axially supported around the boom foot pin 9 so as to be raised and lowered.

In an upper part of the right vertical plate 7, a retaining tool 11 for bundling and retaining a plurality of hydraulic pipes 17 described later is provided. Specifically, the retaining tool 11 is provided on a right surface of the vertical plate 7 so as to avoid contact with the working attachment 4. A position of the retaining tool 11 on the right surface is a position in front of the boss 10, that is, a position on the left side of the fuel tank 5 and above the boss 10. The retaining tool 11 can retain the hydraulic pipes 17 in the lateral direction in a state that the hydraulic pipes are aligned in two lines.

The working attachment 4 is provided with, although not shown in the figure, a boom axially supported by the rotating frame 3, an arm swingably attached to a front part of the boom, a bucket swingably attached to a front part of the arm, and a hydraulic actuator for activating the boom, the arm and the bucket. The hydraulic actuator is provided with a boom cylinder for raising and lowering the boom from the rotating frame 3, an arm cylinder for swinging the arm from the boom, and a bucket cylinder for swinging the bucket from the arm. In the working attachment 4 according to the present embodiment, the bucket can be exchanged with a crusher (not shown), and the crusher is provided with a crushing cylinder for driving a crushing blade.

On the left side of the vertical plates 7 and 8 on the rotating frame 3, a cab (not shown) having an operator's seat is provided. On the right side of the vertical plates 7 and 8 on the rotating frame 3, the fuel tank 5 is provided.

Figure 6:
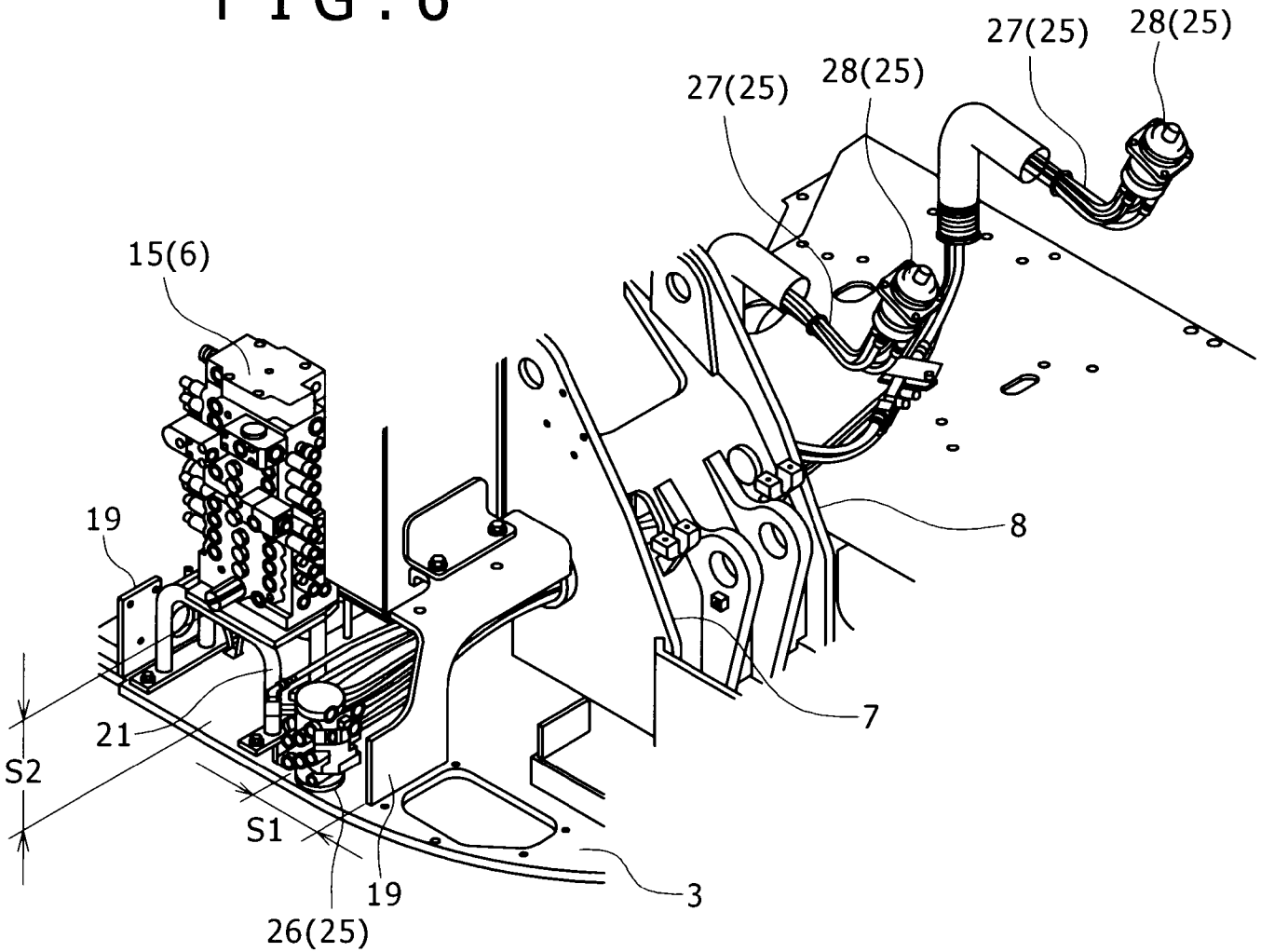
FIG. 6 is a perspective view of the upper rotating body in FIG. 1 particularly showing pilot pipes.

The hydraulic system 6 is provided with a working oil tank 14 arranged behind the fuel tank 5, a control valve 15 attached on a right surface of the working oil tank 14, a swivel joint 16 disposed in the vicinity of a rotation center of the rotating frame 3, hydraulic pipes 17 for coupling the control valve 15 and the hydraulic actuator, relay pipes 18 for coupling the control valve 15 and the swivel joint 16, and an operation member 25 disposed between the operator's seat (not shown) and the control valve 15 (refer to FIG. 6).

Figure 2:
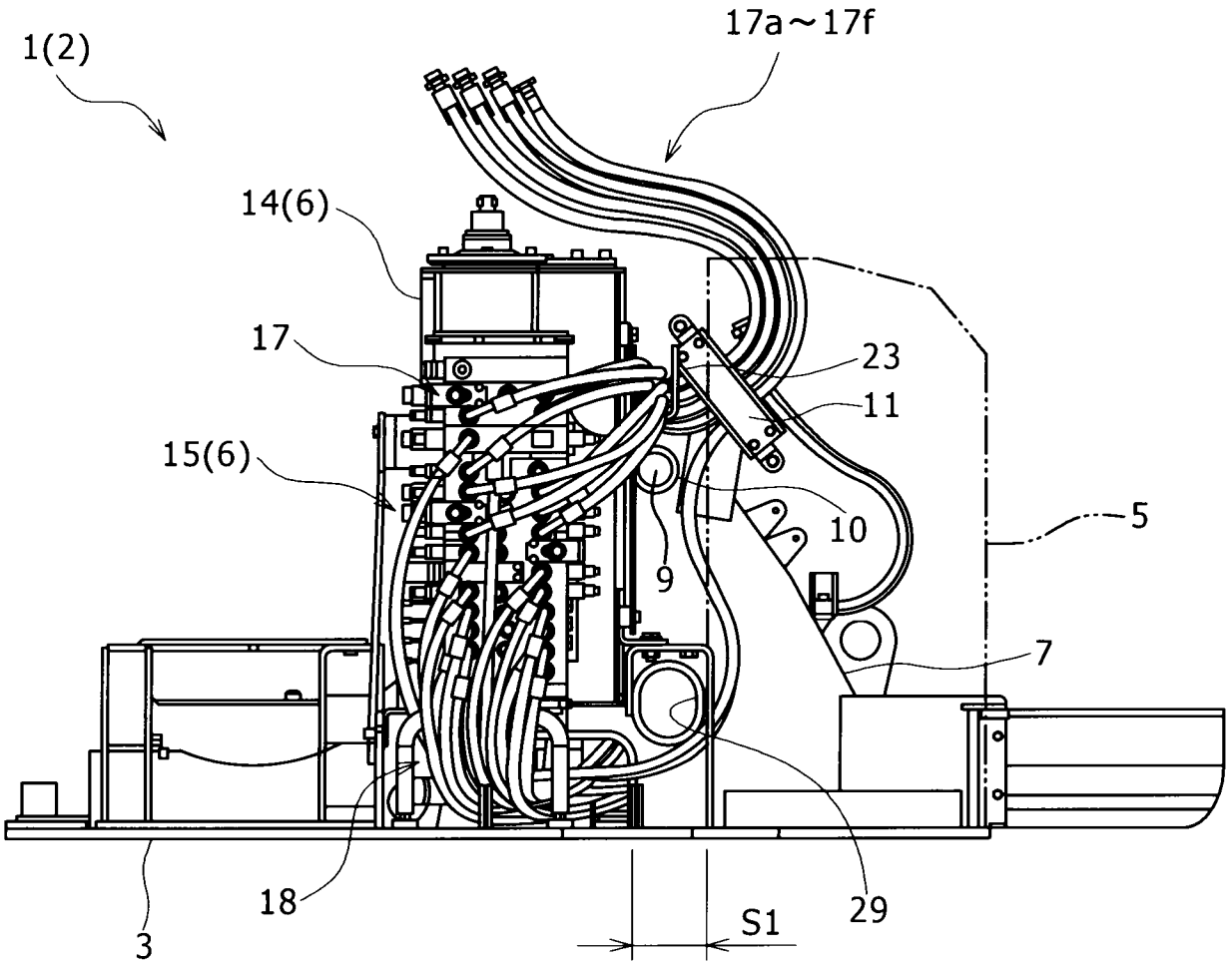
FIG. 2 is a side view of the upper rotating body in FIG. 1.
Figure 4:
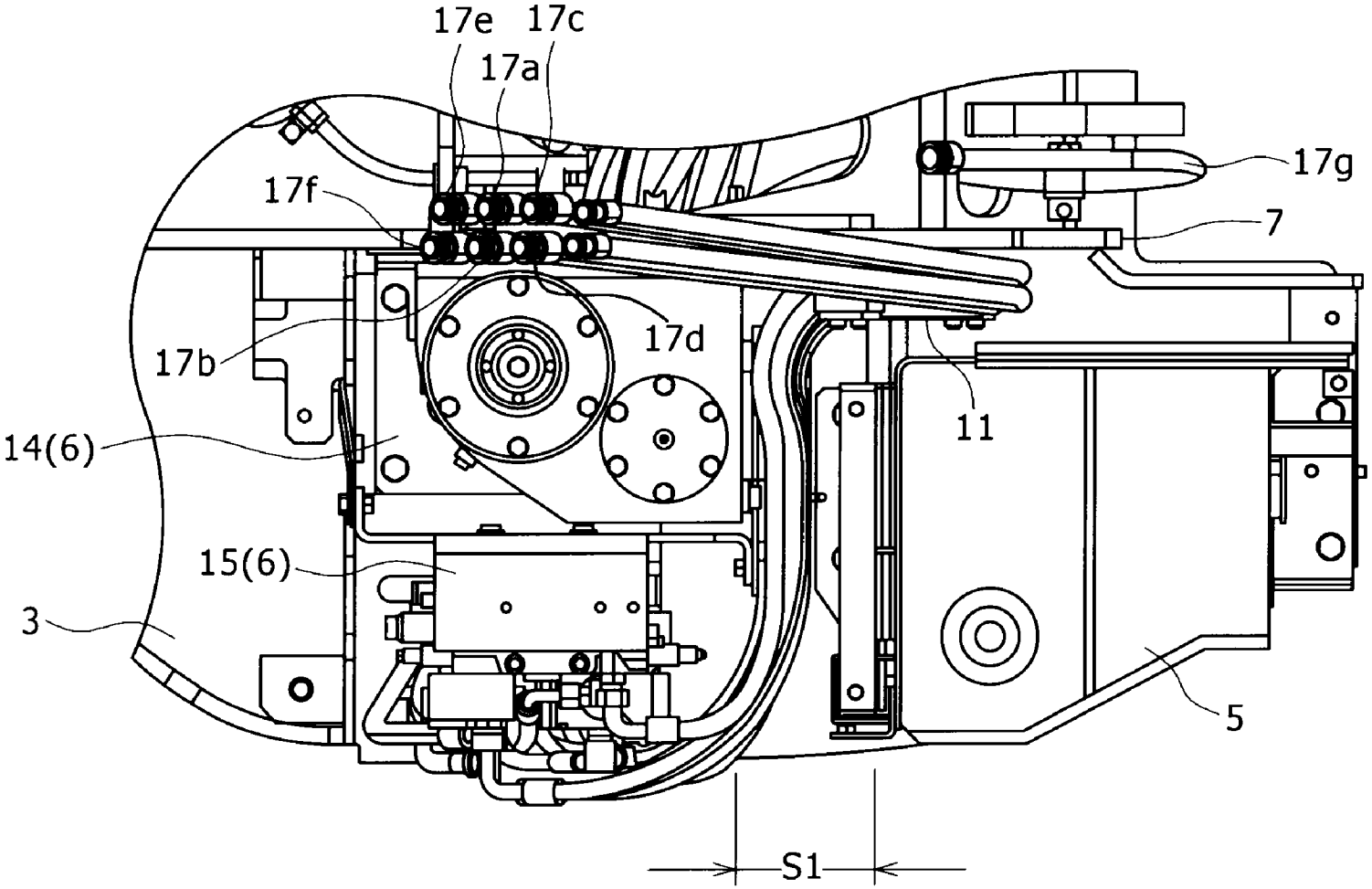
FIG. 4 is a plan view enlarging and showing a part of FIG. 1.

The working oil tank 14 and the fuel tank 5 are arranged apart from each other in the front-back direction as shown in FIGS. 2 and 4. Between the working oil tank 14 and the fuel tank 5, a first clearance S1 is formed. The first clearance S1 is formed at a position where the boss 10 can be seen from the right side as shown in the side view of FIG. 2. Therefore, it is possible to insert and remove the boom foot pin 9 into and from the boss 10 through the first clearance S1. Further, on a front surface of the working oil tank 14, a hook (retaining means) 23 for retaining the hydraulic pipes 17 arranged through the first clearance SI is provided. The hook 23 is a rod-like member in a U shape seen from the side, opening upwards and arranged above the boss 10 of each of the vertical plates 7 and 8. Therefore, in the case where the hydraulic pipes 17 are inserted into and retained by the hook 23 from the upper side, in a view seen from the right side shown in FIG. 2, it is possible to retain the hydraulic pipes 17 at a position where not overlapping with the boss 10. Consequently, insertion and removal work of the boom foot pin 9 is easily performed.

Figure 3:
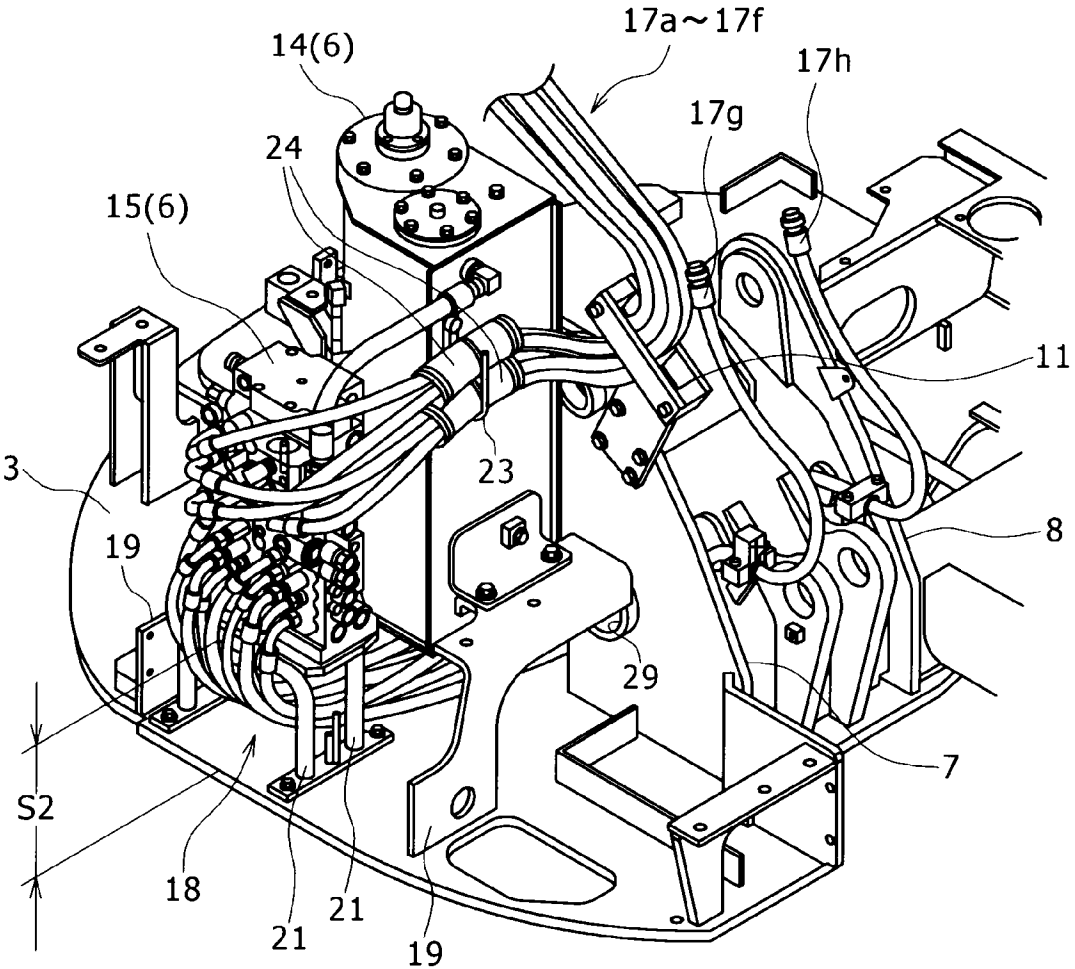
FIG. 3 is a perspective view of the upper rotating body in FIG. 1.

The working oil tank 14 is disposed on upper parts of a pair of front and back foot portions 19, and the control valve 15 is supported on a pair of left and right pipe frames 21 formed in a U shape seen from the side. Therefore, below the working oil tank 14 and the control valve 15, a second clearance S2 shown in FIGS. 2 and 3 is formed. It should be noted that, although not shown in the figure, in the right vertical plate 7, a through hole passing through the vertical plate 7 in the lateral direction is formed at a position corresponding to the second clearance in the front-back direction. Therefore, it is possible to arrange the hydraulic pipes 17 and the relay pipes 18 between both the vertical plates 7 and 8 from the right side of the vertical plate 7 through the through hole and the second clearance S2.

Figure 5:
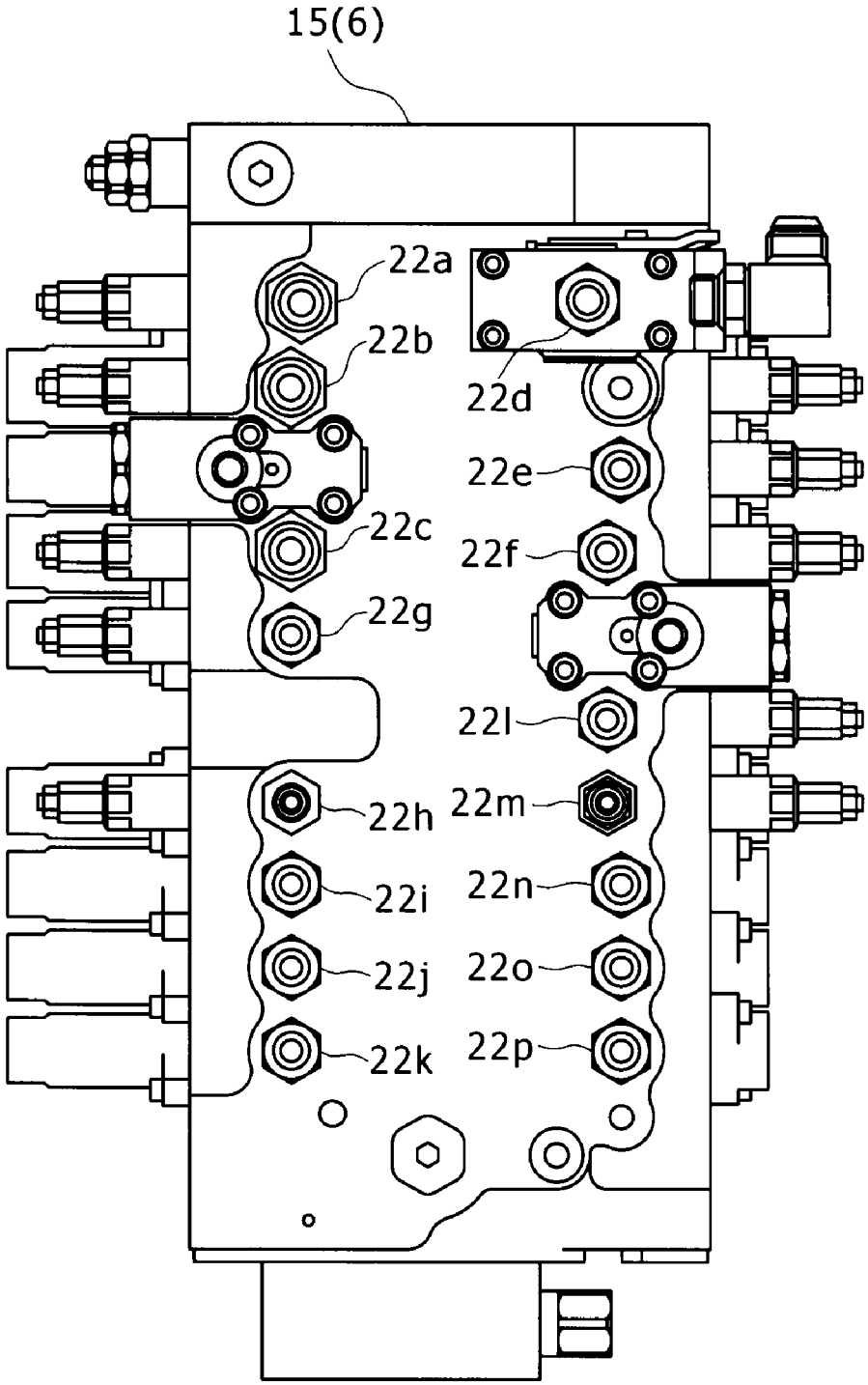
FIG. 5 is a side view enlarging and showing a control valve in the upper rotating body in FIG. 1.

The control valve 15 has ports 22 capable of connecting the hydraulic pipes 17 and the relay pipes 18 on a right surface thereof as shown in FIG. 5. The ports 22 are largely divided into ports for connecting the hydraulic pipes 17 arranged through the first clearance S1, and ports for connecting the hydraulic pipes 17 arranged through the second clearance S2 or the relay pipes 18. Specifically, the upper six ports (first connecting portion) 22*a* to 22*f* among the ports 22 are set to connect the hydraulic pipes 17 arranged through the first clearance S1. Meanwhile, the lower ten ports (second connecting portion) 22*g* to 22*p* among the ports 22 are set to connect the hydraulic pipes 17 arranged through the second clearance S2 or the relay pipes 18. As mentioned above, since the ports 22*a* to 22*f* to be connected to the pipes arranged on the upper side are largely divided from the ports 22*g* to 22*p* to be connected to the pipes arranged on the lower side, it is possible to suppress crossing of the pipes in the up and down direction.

The hydraulic pipes 17 include four hydraulic pipes 17*a* to 17*d* to be connected to the arm cylinder and the bucket cylinder of the working attachment 4, two hydraulic pipes 17*e* and 17*f* to be connected to the crushing cylinder provided in the crusher installed as an optional specification, and two hydraulic pipes 17*g* and 17*h* to be connected to the boom cylinder of the working attachment 4 as shown in FIGS. 3 and 4.

The hydraulic pipes 17*a* to 17*f* are respectively connected to the ports 22*a* to 22*f* on the upper side of the control valve 15. Intermediate parts thereof are arranged to the retaining tool 11 through the first clearance S1 and arranged upwards from the retaining tool 11 so as to be connected to the cylinders of the working attachment 4. As shown in FIG. 2, a part passing through the first clearance S1 among the hydraulic pipes 17*a* to 17*f* is retained by the hook 23 above the boss 10.

Meanwhile, the hydraulic pipes 17*g* and 17*h* are respectively connected to two ports among the ports 22*g* to 22*p* of the control valve 15. The hydraulic pipes are led to between the vertical plates 7 and 8 through the second clearance S2 below the working oil tank 14 and the through hole (not shown) of the vertical plate 7, and connected to the boom cylinder of the working attachment 4 in front of the vertical plates 7 and 8.

As shown in FIG. 3, a part of the hydraulic pipes 17*a* to 17*f* retained by the hook 23 is externally covered with a pair of protection tubes (protection member) 24. Specifically, the protection tube 24 is formed of synthetic resin which is relatively elastic, and bundles three hydraulic pipes among the hydraulic pipes 17*a* to 17*f* in the present embodiment. Since the protection tubes 24 intervene between the hydraulic pipes 17*a* to 17*f* and the hook 23, it is possible to protect the hydraulic pipes 17*a* to 17*f* from the abrasion due to contact with the hook 23 and movement of three hydraulic pipes is restricted by each other. Thereby, it is possible to effectively regulate movement of the hydraulic pipes 17*a* to 17*f* in accordance with a change in internal hydraulic pressure.

Meanwhile, the relay pipes 18 are led to between the vertical plates 7 and 8 respectively through the second clearance S2 and the through hole (not shown) of the vertical plate 7 and connected to the swivel joint 16 here. As mentioned above, the relay pipes 18 are arranged by not avoiding the working oil tank 14 in the planar direction but taking the relay pipes 18 through below the working oil tank 14. Therefore, it is possible to improve efficiency for arrangement space of the relay pipes 18.

As shown in FIG. 6, the operation member 25 is provided with a multi-valve 26 disposed in front of the control valve 15 on the rotating frame 3, first operation pipes 27 arranged from the multi-valve 26 to the operator's seat which is disposed on the left side of the vertical plates 7 and 8, a remote control valve 28 connected to front ends of the first operation pipes 27, and a second operation pipe (not shown) for coupling the multi-valve 26 and the control valve 15.

The operation member 25 forms a flow path for supplying pilot pressure to the control valve 15 through the first operation pipes 27, the remote control valve 28 and the second operation pipe in accordance with operation of the remote control valve 28.

The first operation pipes 27 are led from the multi-valve 26 to the operator's seat through the first clearance S1 as shown in FIG. 6. Specifically, insertion holes 29 are formed to pass through the vertical plates 7 and 8 in the lateral direction below the boss 10, and the first operation pipes 27 are arranged to the operator's seat side through the insertion holes 29. Thereby, the hydraulic pipes 17*a* to 17*f* and the first operation pipes 27 pass through the first clearance S1 in a state that the pipes are divided into the upper and lower sides. Therefore, it is possible to insert and remove the boom foot pin into and from the boss 10 by utilizing space between the hydraulic pipes 17*a* to 17*f* and the first operation pipes 27, and also easily perform discrimination between the hydraulic pipes 17*a* to 17*f* and the first operation pipes 27 on the basis of upper and lower positions of the hydraulic pipes 17*a* to 17*f* and the first operation pipes 27.

It should be noted that in the present embodiment, the multi-valve 26 intervenes between the first operation pipes 27 and the second operation pipe. However, the multi-valve 26 can be omitted and the first operation pipes 27 can be directly connected to the control valve 15. In the above case as well, since the first operation pipes 27 and the hydraulic pipes 17*a* to 17*f* are arranged and divided into the upper and lower sides taking the boss 10 as a border, it is possible to obtain the effect mentioned above.

As mentioned above, according to the embodiment, it is possible to arrange the hydraulic pipes 17*a* to 17*f* retained by the retaining tool 11 through the first clearance S1. Therefore, since there is no need for arranging the pipes so as to take the hydraulic pipes 17*a* to 17*f* through below the working oil tank 14 as in the conventional example, it is possible to shorten an arrangement route of the hydraulic pipes 17*a* to 17*f* in the up and down direction.

As shown in FIG. 3, the hydraulic pipes 17*g* and 17*h* which are arranged between the vertical plates 7 and 8 among the hydraulic pipes 17 are led to between the vertical plates 7 and 8 through the second clearance S2. While, the hydraulic pipes 17*a* to 17*f* which are not arranged between the vertical plates 7 and 8 are led to the retaining tool 11 through the first clearance S1. Therefore, since the hydraulic pipes 17 can be led to between the vertical plates 7 and 8 by taking the hydraulic pipes 17 through below the working oil tank 14, there is no need for avoiding the working oil tank 14 in the planar direction in order to lead the hydraulic pipes 17 to between the vertical plates 7 and 8 so that the efficiency for the arrangement space is improved.

According to the configuration that the relay pipes 18 for connecting the swivel joint 16 and the control valve 15 are arranged through the second clearance S2 as in the embodiment, it is possible to lead the relay pipes 18 to the swivel joint 16 through the second clearance S2 without avoiding the working oil tank 14 in the planar direction. Therefore, it is possible to arrange the relay pipes 18 without changing surface size of the rotating frame 3.

According to the configuration that the control valve 15 is provided with the ports 22*a* to 22*f* for connecting the hydraulic pipes 17*a* to 17*f* passing through the first clearance S1 and the ports 22*g* to 22*p* for connecting the hydraulic pipes 17*g* and 17*h* passing through the second clearance S2 and the relay pipes 18, and the ports 22*a* to 22*f* are formed above the ports 22*g* to 22*p* as in the embodiment, the ports 22*a* to 22*f* for connecting the hydraulic pipes 17*a* to 17*f* to be scheduled to go towards the upper side through the first clearance S1 are arranged on the upper side and the ports 22*g* to 22*p* for connecting the hydraulic pipes 17*g* and 17*h* arranged on the lower side through the second clearance S2 and the relay pipes 18 are arranged on the lower side. Therefore, it is possible to suppress crossing of the pipes 17 and 18 respectively connected to the ports 22*a* to 22*p*. As a result, it is possible to align the pipes 17 and 18 in a regular manner and also to further shorten the arrangement route.

As shown in FIG. 2, according to the configuration that the boss 10 formed in each of the vertical plates 7 and 8 and the first clearance S1 correspond to each other in the front-back direction, it is possible to insert and remove the boom foot pin 9 through the first clearance S1. Therefore, in comparison with the case where there is a need for removing the working oil tank 14 and the fuel tank 5 in order to insert and remove the boom foot pin 9, it is possible to improve workability.

According to the configuration that all the hydraulic pipes 17*a* to 17*f* passing through the first clearance S1 are arranged in a range above the boss 10, while the first operation pipes 27 are arranged in a range below the boss 10 through the first clearance S1 as in the embodiment, the hydraulic pipes 17*a* to 17*f* passing through the first clearance S1 and the first operation pipes 27 are arranged and divided into the upper and lower sides taking a position of the boss 10 as a border. Therefore, it is possible to divide arrangement positions of two types of pipes 17*a* to 17*f* and 27 having different roles from each other into the upper and lower sides. Consequently, it is possible to improve efficiency for arrangement work by suppressing crossing of the hydraulic pipes 17*a* to 17*f* and the first operation pipes 27 or the like.

According to the configuration that the first operation pipes 27 are arranged between the operator's seat and the control valve 15 through the insertion holes 29 as in the embodiment, in comparison with the case of avoiding the vertical plates 7 and 8 in the up and down direction or in the planar direction, it is possible to shorten an arrangement route of the first operation pipes 27. Therefore, it is possible to ease pressure loss within the first operation pipes 27.

According to the configuration that the hook 23 for retaining the hydraulic pipes 17*a* to 17*f* passing through the first clearance S1 is provided as in the embodiment, the hydraulic pipes 17*a* to 17*f* are retained by the hook 23 so that the boss 10 is not hidden by the hydraulic pipes 17*a* to 17*f* passing through the first clearance S1. Therefore, it is possible to perform insertion and removal work of the boom foot pin 9 without disturbance of the hydraulic pipes 17*a* to 17*f*.

According to the configuration that the hook 23 is fixed to the working oil tank 14 as in the embodiment, by attaching the working oil tank 14 to the rotating frame 3 prior to the fuel tank 5, it is possible to arrange the hydraulic pipes 17*a* to 17*f* with utilizing the hook 23. Therefore, in comparison with the case where the hydraulic pipes 17*a* to 17*f* are arranged after the fuel tank 5 is attached to the rotating frame 3, the arrangement work is easily performed by using wide surrounding space.

According to the configuration that the protection tubes 24 are provided as in the embodiment, it is possible to protect the part of the hydraulic pipes 17*a* to 17*f* brought in contact with the hook 23. Therefore, it is possible to suppress abrasion of the hydraulic pipes 17*a* to 17*f* due to sliding with the hook 23.

Although the invention has been described with reference to the preferred embodiments in the attached figures, it is noted that equivalents may be employed and substitutions made herein without departing from the scope of the invention as recited in the claims.

We claim:

1. An upper rotating body of a construction machine, comprising:

a rotating frame rotatably mountable on a lower traveling body;

a pair of left and right vertical plates disposed on said rotating frame and adapted to support a working attachment having an actuator;

a fuel tank provided on the rotating frame at a side of one of said vertical plates opposite from the other vertical plate;

a working oil tank provided on said rotating frame and aligned with said fuel tank in the front-back direction;

a control valve provided on the rotating frame at a side of said working oil tank opposite said one of the vertical plates;

an operation pipe adapted to supply pilot pressure to said control valve, said operation pipe being connected to said control valve;

hydraulic pipes for coupling said control valve and the actuator for the working attachment; and a retaining tool for retaining at least one of said hydraulic pipes, said retaining tool being provided at said one of the vertical plates, wherein a first clearance is formed between said fuel tank and said working oil tank, and a second clearance is formed between said working oil tank and said rotating frame, wherein a given portion of said hydraulic pipes, which given portion is less than all of said hydraulic pipes, is led to a space between said vertical plates via said second clearance, and a remaining portion of said hydraulic pipes is not led to the space between said vertical plates and is led to said retaining tool through said first clearance, wherein a pin inserting and removing portion into and from which a boom foot pin for axially supporting said attachment is insertable and removable in the lateral direction is formed in each of said vertical plates, and said pin inserting and removing portion and said first clearance are provided at corresponding positions in the front-back direction, wherein said remaining portion of the hydraulic pipes passing through said first clearance is arranged on the upper side of said pin inserting and removing portion, while said operation pipe is arranged below said pin inserting and removing portion through said first clearance.

2. The upper rotating body of the construction machine according to claim 1, further comprising:

a swivel joint adapted to supply working oil to said lower traveling body, said swivel joint being provided on said rotating frame; and relay pipes for coupling said swivel joint and said control valve, said relay pipes being arranged through said second clearance.

3. The upper rotating body of the construction machine according to claim 2, wherein said control valve is provided with a first connecting portion for connecting said remaining portion of the hydraulic pipes passing through said first clearance, and a second connecting portion for connecting said given portion of the hydraulic pipes passing through said second clearance and said relay pipes, and said first connecting portion is formed on the upper side of said second connecting portion.

4. The upper rotating body of the construction machine according to claim 1, wherein said operation pipe is extended between said control valve and an operator's seat provided on a side of said vertical plates opposite said control valve via insertion holes formed in said vertical plates.

5. The upper rotating body of the construction machine according to claim 1, further comprising:

retaining means for retaining said remaining portion of the hydraulic pipes passing through said first clearance, said retaining means capable of retaining said remaining portion of the hydraulic pipes so that said hydraulic pipes are not overlapped with said pin inserting and removing portion when said pin inserting and removing portion is seen from the side through said first clearance.

6. The upper rotating body of the construction machine according to claim 5, wherein said retaining means is fixed to said working oil tank.

7. The upper rotating body of the construction machine according to claim 5, wherein said retaining means has a hook portion adapted to accept said remaining portion of the hydraulic pipes from the upper side and regulate frontward, rearward and downward movement of said hydraulic pipes, and a protection member installed to said hydraulic pipes so as to cover a part retained by said hook portion.

* * * * *